US009714507B1

(12) United States Patent
Snell

(10) Patent No.: US 9,714,507 B1
(45) Date of Patent: Jul. 25, 2017

(54) TOILET CLEANER SPRAY HOSE AND DEODORIZER

(71) Applicant: Jose L. Snell, Edinburg, TX (US)

(72) Inventor: Jose L. Snell, Edinburg, TX (US)

( * ) Notice: Subject to any disclaimer, the term of this patent is extended or adjusted under 35 U.S.C. 154(b) by 0 days.

(21) Appl. No.: 14/837,794

(22) Filed: Aug. 27, 2015

Related U.S. Application Data

(60) Provisional application No. 62/042,489, filed on Aug. 27, 2014.

(51) Int. Cl.
*E03D 9/02* (2006.01)
*E03D 9/08* (2006.01)
*E03D 9/00* (2006.01)

(52) U.S. Cl.
CPC ..... *E03D 9/085* (2013.01); *E03D 9/005* (2013.01)

(58) Field of Classification Search
CPC ..... E03D 9/005
USPC ..... 4/222–233
See application file for complete search history.

(56) References Cited

U.S. PATENT DOCUMENTS 2,424,174 A 7/1947 Jensen et al.
4,650,470 A * 3/1987 Epstein ..... A61M 3/025 137/625.48
4,890,340 A * 1/1990 Lovitt ..... A61M 3/0258 4/443
5,063,618 A * 11/1991 Souka ..... E03D 9/08 4/420.4
6,167,577 B1 * 1/2001 Hammad ..... E03D 9/08 4/420.4
6,321,392 B1 11/2001 Sim
6,662,379 B2 12/2003 Nguyen et al.
6,789,552 B1 * 9/2004 Robinson ..... A47K 11/10 134/22.18
7,000,854 B2 * 2/2006 Malek ..... B05B 1/1618 137/625.48
7,013,502 B2 * 3/2006 Pacheco ..... E03D 9/08 4/420.2
7,461,414 B2 * 12/2008 Santa Cruz ..... E03D 9/085 4/420.2
7,770,822 B2 * 8/2010 Leber ..... B05B 15/061 239/280
8,117,682 B1 * 2/2012 Bowden ..... E03D 9/085 4/223
8,281,423 B2 * 10/2012 Taylor ..... A47K 7/08 4/420.4

(Continued)

FOREIGN PATENT DOCUMENTS

EP 2495054 A2 5/2012
WO 2011122768 A2 6/2011

*Primary Examiner* — Lori Baker
(74) *Attorney, Agent, or Firm* — Robert C Montgomery; Montgomery Patent & Design LP

(57) ABSTRACT

A toilet sprayer having a mixing reservoir assembly for receiving incoming fresh water from a service line and for holding deodorizing tablets such that the deodorizing tablets mixes with incoming fresh water to form a solution. A spray hose in fluid communication with the mixing reservoir receives the solution. The spray hose connects to a hand-held spray wand assembly for emitting released solution from the spray hose. A shut-off valve can be used to shut off incoming water, a proportional valve can be used to adjust the concentration of the solution, a control valve controls the flow of solution from the spray wand assembly, and the spray wand assembly includes an adjustable spray head.

17 Claims, 3 Drawing Sheets

(56) References Cited

U.S. PATENT DOCUMENTS

| | | | | |
|---|---|---|---|---|
| 2007/0289054 | A1 | 12/2007 | Han et al. | |
| 2009/0045271 | A1 | 2/2009 | Alexander et al. | |
| 2010/0044601 | A1 | 2/2010 | Weigen | |
| 2015/0026873 | A1* | 1/2015 | Becker | B05B 7/2402 4/223 |

* cited by examiner

TOILET CLEANER SPRAY HOSE AND DEODORIZER

RELATED APPLICATIONS

This application claims the benefit of U.S. Provisional Application No. 62/042,489, which was filed Aug. 27, 2014, the entire disclosures of which are incorporated herein by reference.

FIELD OF THE INVENTION

The presently disclosed subject matter relates to cleaning and deodorizing bathrooms. More particularly, it is directed to a toilet sprayer for delivering a controlled flow of deodorizing and cleaning solution into a toilet bowl.

BACKGROUND OF THE INVENTION

Whether performed by a professional or by the person that cleans the house, as many a person can attest dealing with a messy bathroom is an unsanitary and thankless task. Regarding one task in particular one may long wait in vain for a volunteer who is willing to clean a toilet bowl.

The rather revolting bodily waste, stains, and other mineral deposits make the task of actually obtaining a clean and hygienic toilet is difficult to accomplish. Obtaining the proper deodorizers and cleaners as well as the required brushes for the task at hand can be difficult and time consuming. Then, actually cleaning the toilet, particularly its bowl, is trying. Many times cleaning with a strong sanitizing solution is necessary and, most unfortunately, repeated scrubbing and wiping is usually required.

Therefore, a device that makes cleaning a toilet bowl easier and faster would be advantageous. Preferably such a device would enable a hygienic and easy way to clean a toilet bowl. Preferably such a device would reduce or eliminate human contact with a toilet.

SUMMARY OF THE INVENTION

The principles of the present invention provide for a device that makes cleaning a toilet bowl easier and faster. The device also enables a hygienic and easy way to clean a toilet bowl with either reduced or no human contact with the toilet.

A toilet sprayer in accord with the present invention includes a mixing reservoir assembly for receiving incoming fresh water from a service line and for holding at least one (1) deodorizing tablet such that the deodorizing tablet mixes with incoming fresh water to form a solution. Also included is a spray hose that is in fluid communication with the mixing reservoir so as to receive the solution. The spray hose connects to a hand-held spray wand assembly for emitting released solution from the spray hose.

The toilet sprayer can include a cylindrical lid that holds the mixing reservoir. Preferably the mixing reservoir is threaded onto the cylindrical lid. That cylindrical lid may include a mounting ear having a fastener aperture for receiving a fastener to attach the cylindrical lid to a wall proximate a toilet. The cylindrical lid may further include a fresh water inlet and a solution outlet that is connected to the spray hose. There may be a supply valve disposed inline between said fresh water inlet and a water service line. That supply valve enables a user to selectively shut off the flow of fresh water to the fresh water inlet.

In practice the cylindrical lid can also include an internal inlet tube that is attached to the fresh water inlet and that extends downward to the bottom of the reservoir. The inlet tube may then include at least one (1) inlet tube aperture that directs fresh water to promote dissolving of the deodorizing tablets. There may also be an outlet tube for directing solution to the outlet connection as well as a proportioning valve that is attached to the outlet tube. The proportioning valve can be used by a user to selectively direct fresh water past the reservoir to vary the concentration of the solution.

Beneficially, the toilet sprayer has a spray hose of a sufficient length of flexible hosing to position the distal end of the spray hose over a toilet bowl. That distal end may include a hose fitting for connecting to a hose connector of the spray wand assembly. The spray wand assembly should have a wand handle with a spray head. That spray head should extend perpendicular from the remainder of the wand handle to enable a user to easily direct the flow of the solution. That wand handle may include a spray valve for controlling the flow of solution. The spray valve is beneficially spring biased to automatically shut off the flow of solution. The spray valve may be provided with a user accessible valve handle. The toilet sprayer can also have a holster that is configured to receive the spray head along a side of a toilet. The holster can have an inverted "U"-shaped holster appendage and a cup-shaped holster aperture for receiving a spray nozzle.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
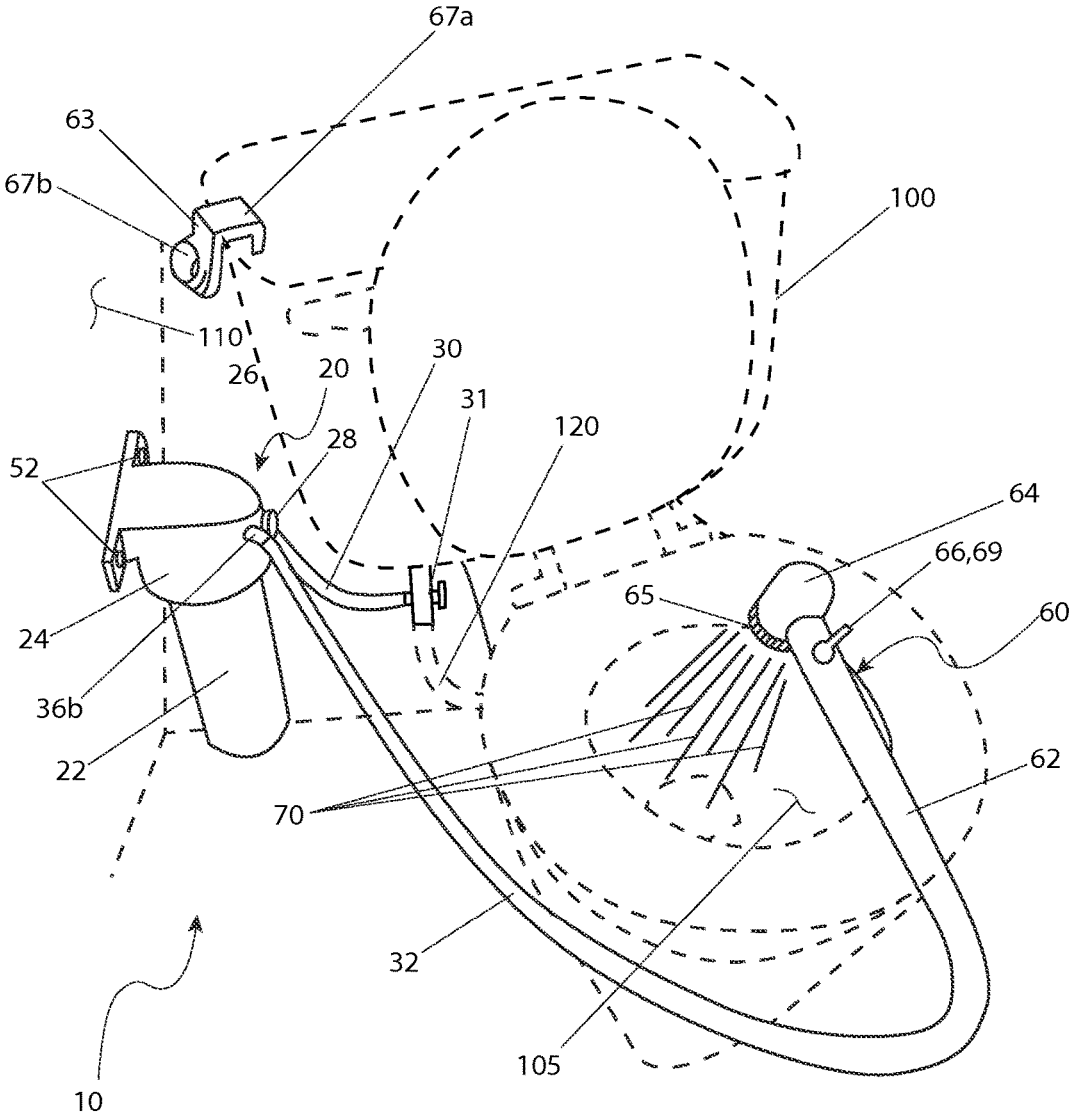
FIG. 1 is an environmental view of a toilet sprayer 10 that is in accord with a preferred embodiment of the present invention when in an in-use state.

10 toilet sprayer
20 reservoir assembly
22 reservoir
24 lid
26 mounting ear
27 fastener aperture
28 proportioning valve
30 supply hose
31 supply valve
32 spray hose
34 hose fitting
36*a* inlet connection
36*b* outlet connection
38*a* male threaded region
38*b* female threaded region
40*a* inlet tube
40*b* inlet tube aperture
41 outlet tube
42 reservoir chamber
50 deodorizing tablet
52 fastener
60 spray wand assembly

61*a* first port
61*b* second port
62 wand handle
63 holster
64 spray head
65 spray nozzle
66 spray valve
67*a* holster appendage
67*b* holster aperture
68 hose connection
69 valve handle
70 spray solution
100 toilet
105 toilet bowl
110 wall
120 water service line

DETAILED DESCRIPTION OF THE PREFERRED EMBODIMENT

Figure 2:
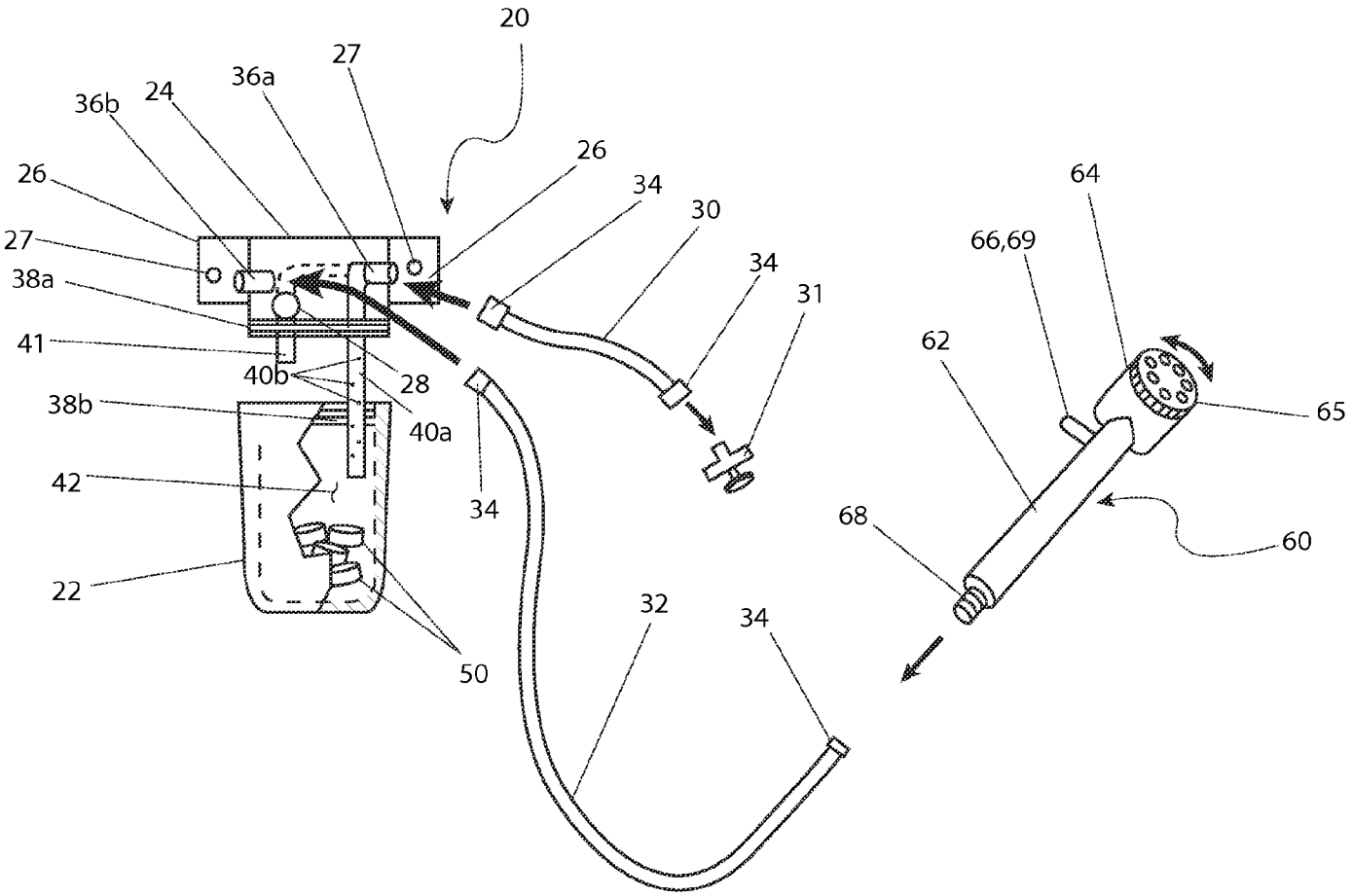
FIG. 2 is an exploded view of the toilet sprayer 10 shown in FIG. 1; and, FIG. 3 is a sectional view of a spray wand assembly 60 portion of the toilet sprayer 10.
Figure 3:
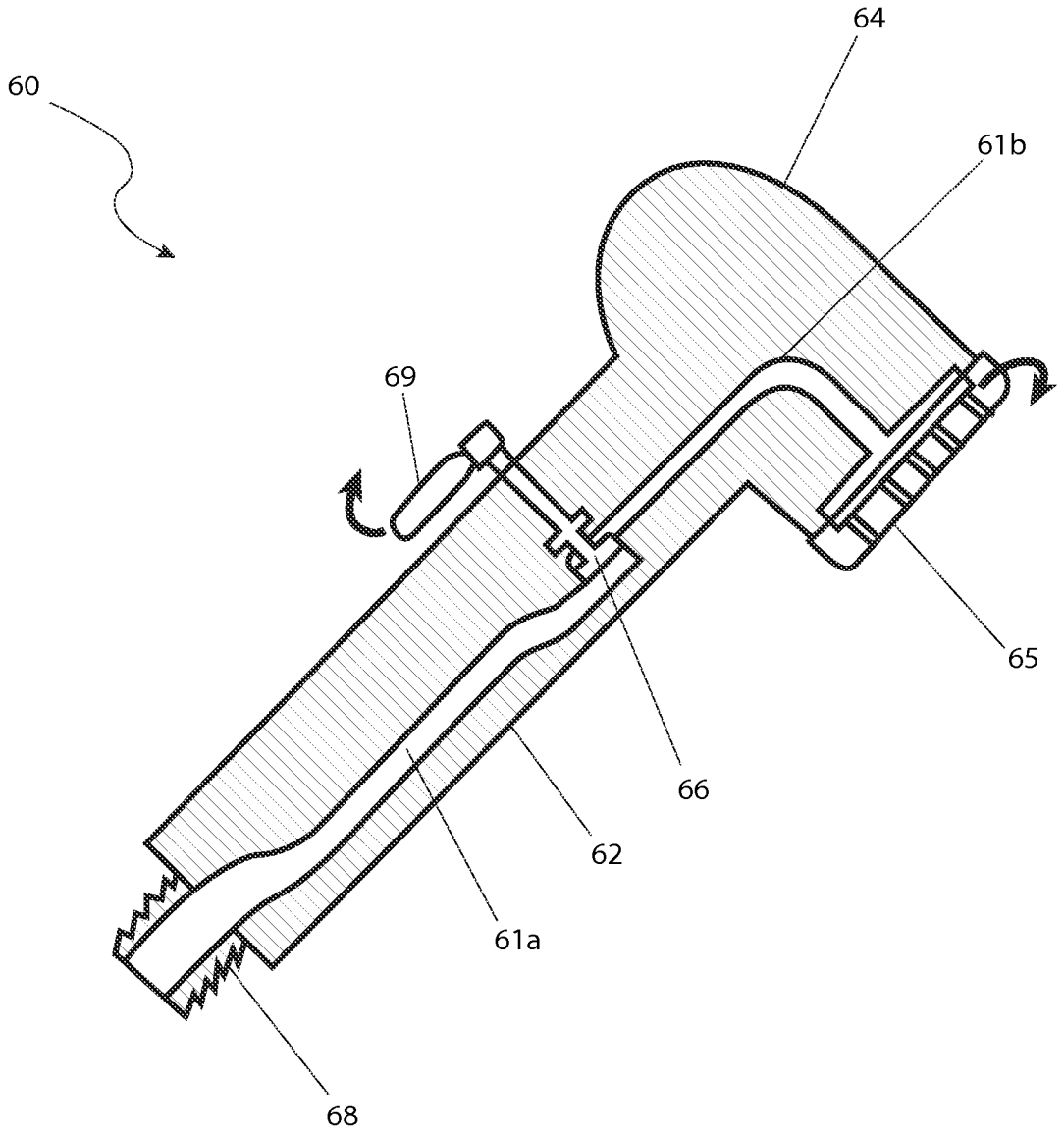

The preferred embodiment of the present invention is depicted within FIGS. 1-3. However, the invention is not limited to what is specifically illustrated and described. A person skilled in the art will appreciate that many other embodiments of the invention are possible without deviating from the basic concept of the invention. Any such work around also falls with the scope of this invention.

The terms "a" and "an" herein do not denote a limitation of quantity, but rather denote the presence of at least one of the referenced items. In addition, unless otherwise denoted all directional signals such as up, down, left, right, inside, outside are taken relative to the illustration shown in FIG. 1.

Referring now to FIG. 1, the present invention describes a toilet sprayer 10 which provides a means to clean and deodorize a toilet 100. The toilet sprayer 10 provides a mixing reservoir assembly 20 that contains a quantity of deodorizing tablets 50. The toilet sprayer 10 further includes a spray hose 32 and a hand-held spray wand assembly 60. The toilet sprayer 10 is envisioned as being installed adjacent an existing toilet 100 and in fluid communication with an existing water service line 120. The water service line 120 provides a supplying of fresh, pressurized water to the reservoir assembly 20. The water mixes with the deodorizing tablets 50 to form a cleaning and deodorizing spray solution 70. The toilet sprayer 10 is envisioned as being made of rugged plastic or metal that is finished in a variety of colors and patterns to match an existing bathroom décor.

Referring now also to FIG. 2, the reservoir assembly 20 has a cup-shaped reservoir 22 with an internal reservoir chamber 42 that holds the deodorizing tablets 50. In use the deodorizing tables 50 are dissolved to produce the spray solution 70. The reservoir 22 may also contain various other commercially-available products such as additional cleaners, deodorizers, fragrance enhancer and the like. Those products can be chosen based upon a user's preferences to refresh and restore the toilet bowl 105 of the toilet 100.

The reservoir 22 threads into a cylindrical lid 24 which is preferably fixed on a wall 110 that is adjacent the toilet 100 via integral mounting ear 26. The mounting ears 26 each include a fastener aperture 27 which receives a fastener 52 which connects the lid 24 to the wall 110. Of course, the lid 24 may be mounted to another suitable structure in close proximity to the toilet 100 or to the wall using another fastening technique. The lid 24 includes an integral inlet and an integral outlet which are threaded piping features that form the inlet connection 36*a* and an outlet connection 36*b*. The inlet connection 36*a* supports a fluid connection to a supply valve 31 that is inserted between the inlet connection 36*a* and an existing water service line 120. The supply valve 31 enables a user to selectively shut off the fresh water to the toilet sprayer 10. The integral outlet connection 36*b* provides a threaded plumbing connection to a proximal end of a flexible spray hose 32.

Turning now also to FIG. 3, the spray hose 32 provides a sufficient length of flexible hosing to position the distal end of the spray hose 32 over the toilet bowl 105. The distal end includes a threaded hose fitting 34 for connecting to a hose connector 68 of the spray wand assembly 60. The spray wand assembly 60 enables a user to service the toilet 100 by spraying the spray solution 70 into the toilet bowl 105 in a hand-held spraying manner.

As shown in FIG. 1, the toilet sprayer 10 also includes a holster 63. The holster 63 enables a user to park a spray head 64 of the spray wand assembly 60 along the side of the toilet 100. The holster 63 is a unitary molded plastic member having an inverted "U"-shaped holster appendage 67*a* for hanging the holster 63 on the edge of the toilet 100. The holster 63 also includes a cup-shaped holster aperture 67*b* that is sized to receive and retain a spray nozzle 65 of the spray wand assembly 60.

Referring now primarily to FIG. 2, as previously noted the reservoir assembly 20 mixes incoming fresh water with the deodorizing tablets 50 and with any other product placed in the reservoir assembly 20 to produce the spray solution 70. The incoming fresh water is supplied via the supply valve 31 and the supply hose 30. The spray solution 70 is then conveyed through the spray hose 32 to the spray wand assembly 60.

Mixing within the reservoir assembly 20 occurs when the water enters through the inlet connection 36*a* and an integral inlet tube 40*a*. The inlet tube 40*a* extends downward to the bottom of the reservoir 22 and has a closed bottom end. Water exits the inlet tube 40*a* via inlet tube apertures 40*b* that are beneficially equally-spaced along the inlet tube 40*a* to promote dissolving of the deodorizing tablets 50. As water flows over the deodorizing tablets 50 and/or other products in the reservoir assembly 20 the cleaning and/or deodorizing spray solution 70 is created. The spray solution 70 exits the reservoir assembly 20 through the outlet tube 41 and its associated outlet connection 36*b*. The outlet tube 41 is located near the top of the reservoir 22 to prevent blockage of the outlet tube 41 by the deodorizing tablets 50. The outlet connection 36*b* provides a threaded connection to the spray hose 32, which in turn conveys the spray solution 70 to the spray wand assembly 60. The reservoir assembly 20 also includes a proportioning valve 28 that is beneficially located upon the outlet tube 41. The proportioning valve 28 acts as a bypass valve to enable a user to selectively direct a portion of the fresh water past the reservoir 22, thereby vary the resulting concentration of the spray solution 70 if so desired.

The spray wand assembly 60 includes an ergonomic cylindrical wand handle 62 having an integral spray head 64. The wand handle 62 also includes the integral hose connection 68 which enables a threaded attachment to the spray hose 32. The spray head 64 is preferably arranged perpendicular to the wand handle 62 to direct the spray solution 70 into the toilet bowl 105 (best seen in FIG. 1). The wand handle 62 also provides a lever-type spring-return spray valve 66 which allows a user to easily control flow. The spray valve 66 is spring biased to automatically close, thus preventing flow of the spray solution 70. As the user rotates a valve handle 69 of the spray valve 66 the flow of the spray solution 70 passing through the spray nozzle 65 is controlled in a similar manner as in a common shower head.

Referring now primarily to FIG. 3, the spray wand assembly 60 includes the hose connection 68, a first port 61*a*, the spray valve 66, the valve handle 69, a second port 61*b*, and the spray nozzle 65. In use, the spray solution 70 enters the first port 61*a* via the hose connection 68 where the solution is subsequently regulated by the spray valve 66 using the valve handle 69. The spray solution 70 then flows through the second port 61*b* and out of the spray nozzle 65. The spray nozzle 65 is rotatingly affixed to the spray head 64 to allow a user to select a desired spray, shower, or jet spray pattern.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the toilet sprayer 10, it would be installed as indicated in FIG. 1. The method of installing and utilizing the toilet sprayer 10 may be achieved by: procuring a model of the toilet sprayer 10 having a desired color; mounting the lid 24 of the reservoir assembly 20 to a wall 110 (or other suitable structure), by installing fasteners 52 through fastener aperture 27 of each mounting ear 26 of the lid 24; installing the supply hose 30 and the supply valve 31 in-line with an existing pressurized service line 120 supplying fresh water to the water closet using conventional plumbing methods; installing the supply hose 30 to the inlet connection 36*a* of the lid 24 using the hose fitting 34 of the supply hose 30; installing the hose fitting 34 of the spray hose 32 to the outlet connection 36*b* of the lid 24; connecting the spray wand assembly 60 to the spray hose 32 using the respective hose connection 68 and hose fitting 34; hanging the holster 63 upon an edge of the toilet closet 100; parking the spray wand assembly 60 in the holster aperture 67*b* of the holster 63; loading a quantity of deodorizing tablets 50 or other desired products such as cleaning products, deodorizing products, fragrance enhanced solid and liquid products, and the like, into the reservoir chamber 42 to produce the spray solution 70; installing the reservoir 22 onto the lid 24 by engaging a respective female threaded region 38*b* and a male threaded region 38*a*; initiating the flow of fresh water into the toilet sprayer 10 by remotely actuating the water supply valve 31; grasping the wand handle 62 of the spray wand assembly 60; aiming the spray head 64 toward a toilet bowl 105 of the toilet 100; initiating a flow of spray solution 70 from the spray nozzle 65 by turning the valve handle 69 using one's fingers; rotating the spray nozzle 65 as needed to obtain a desired spray pattern from the spray head 64; dispensing the desired volume of spray solution 70 into the toilet bowl 105; restoring the valve handle 69; placing the spray head 64 into the holster 63 until needed again; repeating the dispensing of the spray solution 70 periodically into the toilet bowl 105 as needed; adjusting the concentration of the spray solution 70, as needed, using the proportioning valve 28 of the reservoir assembly 20; utilizing the toilet sprayer 10 until the deodorizing tablets 50 are completely dissolved; replenishing the deodorizing tablets 50 by remotely shutting of the water supply and repeating the appropriate steps listed above; and, benefiting from convenient mixing and dispensing of a spray solution 70 used to clean and/or deodorize a toilet bowl 105 in a hand-held manner afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A toilet sprayer, comprising:

a mixing reservoir assembly for receiving incoming fresh water from a service line and for holding at least one deodorizing tablet such that said deodorizing tablet mixes with incoming fresh water to form a solution;

a cylindrical lid that holds said mixing reservoir, including a mounting ear having a fastener aperture for receiving a fastener that connects said cylindrical lid to a wall proximate a toilet;

a spray hose in fluid communication with said mixing reservoir so as to receive said solution; and, a hand-held spray wand assembly in fluid communication with said spray hose, said hand-held spray wand assembly for emitting released solution from said spray hose.

2. The toilet sprayer according to claim 1, wherein said mixing reservoir is threaded onto said cylindrical lid.

3. The toilet sprayer according to claim 1, wherein said cylindrical lid further includes a fresh water inlet and a solution outlet for connecting to said spray hose.

4. The toilet sprayer according to claim 3, further including a supply valve disposed between said fresh water inlet and a water service line; wherein said supply valve enables a user to selectively shut off the flow of fresh water to said fresh water inlet.

5. The toilet sprayer according to claim 1, wherein said cylindrical lid further includes an inlet tube attached to said fresh water inlet and that extends downward to the bottom of said reservoir.

6. The toilet sprayer according to claim 5, wherein said inlet tube includes at least one inlet tube aperture that directs fresh water so as to promote dissolving of the deodorizing tablets.

7. The toilet sprayer according to claim 6, further including an outlet tube for directing said solution to said outlet connection.

8. The toilet sprayer according to claim 6, further including a proportioning valve that enables a user to selectively direct fresh water past the reservoir to vary the concentration of said solution.

9. The toilet sprayer according to claim 1, wherein said spray hose includes a sufficient length of flexible hosing to position the distal end of the spray hose over a toilet bowl.

10. The toilet sprayer according to claim 9, wherein said distal end of said spray hose includes a hose fitting for connecting to a hose connector of said spray wand assembly.

11. The toilet sprayer according to claim 10, wherein said spray wand assembly includes a wand handle having a spray head.

12. The toilet sprayer according to claim 11, wherein said spray head extends perpendicular from the remainder of said wand handle.

13. The toilet sprayer according to claim 12, wherein said wand handle includes a spray valve for controlling the flow of solution through said spray head.

14. The toilet sprayer according to claim 13, wherein said spray valve is spring biased to shut off the flow of solution.

15. The toilet sprayer according to claim 14, wherein said spray valve is provided with a user accessible valve handle.

16. The toilet sprayer according to claim 1, further including a holster configured to receive the spray head along a side of a toilet.

17. The toilet sprayer according to claim 16, wherein said holster includes an inverted "U"-shaped holster appendage and a cup-shaped holster aperture for receiving a spray nozzle.

* * * * *